US007686652B2

(12) United States Patent
Yu et al.

(10) Patent No.: US 7,686,652 B2
(45) Date of Patent: Mar. 30, 2010

(54) MEMORY CARD CONNECTOR WITH IMPROVED CONTACT ARRANGEMENT

(75) Inventors: Jian-Fei Yu, Kunshan (CN); Qi-Jun Zhao, Kunshan (CN); Hua Yin, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/315,393

(22) Filed: Dec. 3, 2008

(65) Prior Publication Data

US 2009/0142948 A1 Jun. 4, 2009

(30) Foreign Application Priority Data

Dec. 3, 2007 (CN) ..... 2007 2 0131189 U

(51) Int. Cl.
*H01R 24/00* (2006.01)

(52) U.S. Cl. ..... 439/630; 439/188; 439/159

(58) Field of Classification Search ..... 439/159, 439/607.01, 607.31, 630
See application file for complete search history.

(56) References Cited

U.S. PATENT DOCUMENTS 5,997,356 A * 12/1999 Chang ..... 439/630
6,875,033 B2 4/2005 Sato et al.
7,044,797 B1 5/2006 Lai
7,070,430 B2 * 7/2006 Yang et al. ..... 439/159
7,261,576 B2 * 8/2007 Miyamoto ..... 439/159
2005/0221649 A1 * 10/2005 Tanaka et al. ..... 439/159

FOREIGN PATENT DOCUMENTS

TW M288730 3/2006

* cited by examiner

*Primary Examiner*—Tho D Ta
*Assistant Examiner*—Travis Chambers
(74) *Attorney, Agent, or Firm*—Wei Te Chung; Andrew C. Cheng; Ming Chieh Chang

(57) ABSTRACT

A USB card connector includes an insulative housing and a plurality of contacts retained in the insulative housing. The insulative housing includes a rear wall and a card receiving cavity located forward the rear wall. Each contact includes a contact portion protruding to the card receiving cavity. The contacts are divided into first and second contact groups with same contact arrangement in condition that each the first or the second contact group comprises four contacts for transmitting USB or similar-USB signals.

16 Claims, 10 Drawing Sheets

MEMORY CARD CONNECTOR WITH IMPROVED CONTACT ARRANGEMENT

BACKGROUND OF THE INVENTION

1. Field of the Invention

This invention generally relates to a memory card connector, and more particularly to a Universal Serial Bus (USB) card connector with improved contact arrangement.

2. Description of Related Art

Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

With development of electronic devices, there are many kinds of memory cards such as SD card, MMC card, MS card, xD card etc. However, how to enhance signal transmissions of such memory cards is a great difficulty. Taiwan Pat. No. M288730 discloses a special memory card called USB card and a mateable card connector. The memory card uses four contact pads similar to USB standard for signal transmission. However, the number of contact pads is so small and may restrict high speed signal transmission. Besides, the structure of the card connector doesn't have card ejection mechanism and is not easy for usage.

Hence, it is desired to have a memory card connector solving the problems above.

BRIEF SUMMARY OF THE INVENTION

A Universal Serial Bus (USB) card connector includes an insulative housing, a plurality of contacts retained in the insulative housing and a card ejection mechanism mounted on the insulative housing. The insulative housing includes a rear wall and a card receiving cavity located forward the rear wall. Each contact includes a contact portion protruding to the card receiving cavity. The contacts are divided into first and second contact groups with same contact arrangement in condition that each the first or the second contact group comprises four contacts for transmitting USB or similar-USB signals. A space between the first and the second contact groups is much larger than that of the adjacent two contacts in each the first or the second contact group. The card ejection mechanism includes a slider mounted on a bottom wall of the insulative housing, a spring and a link rod mating with the slider. The spring includes one end abutting against the insulative housing and the other end abutting against the slider. The insulative housing defines a heart-shaped cam. The link rod includes one hook retained in the insulative housing and the other hook movable in the heart-shaped cam.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
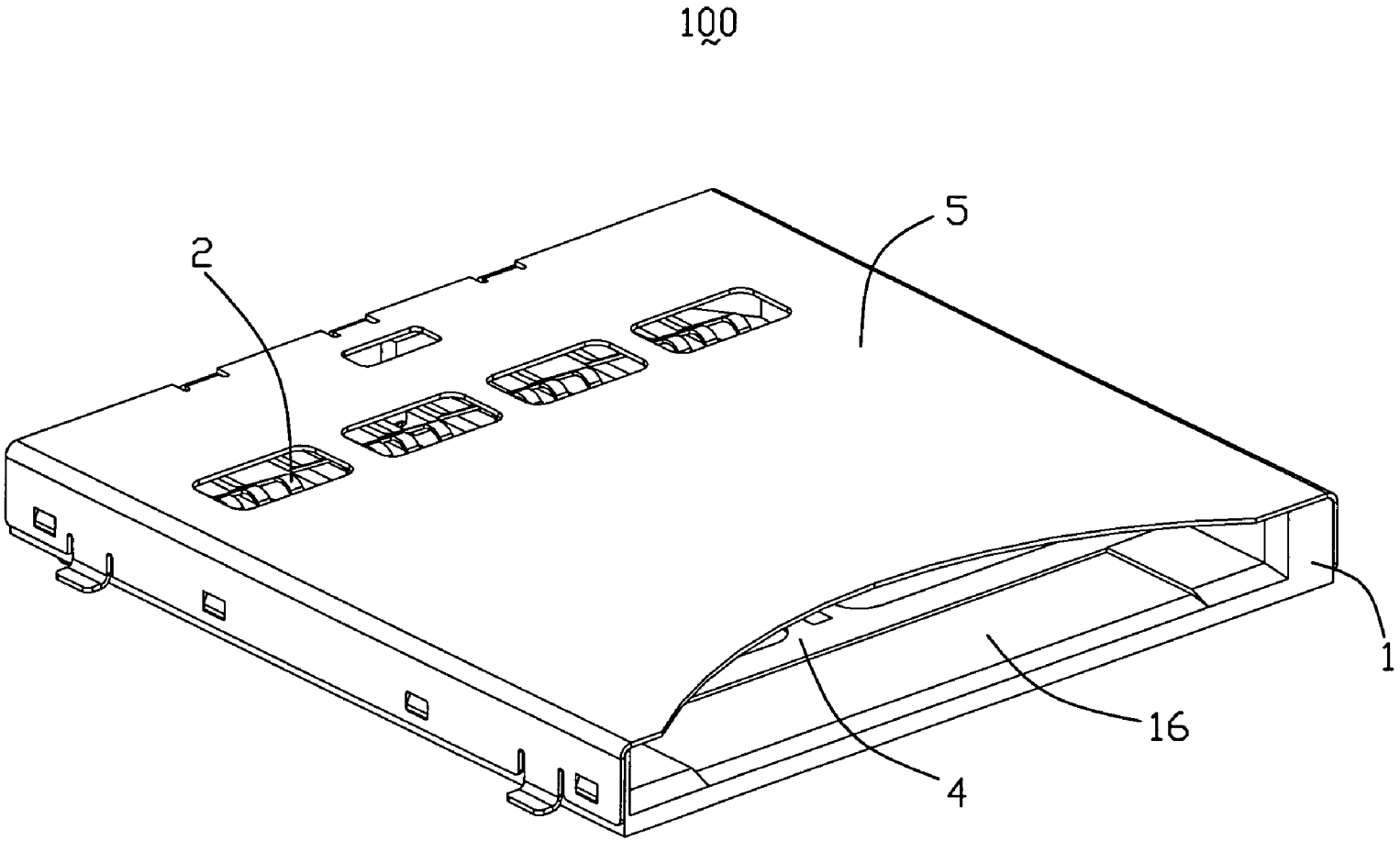
FIG. 1 is a perspective view of a memory card connector according to a preferred embodiment of the present invention.
Figure 2:
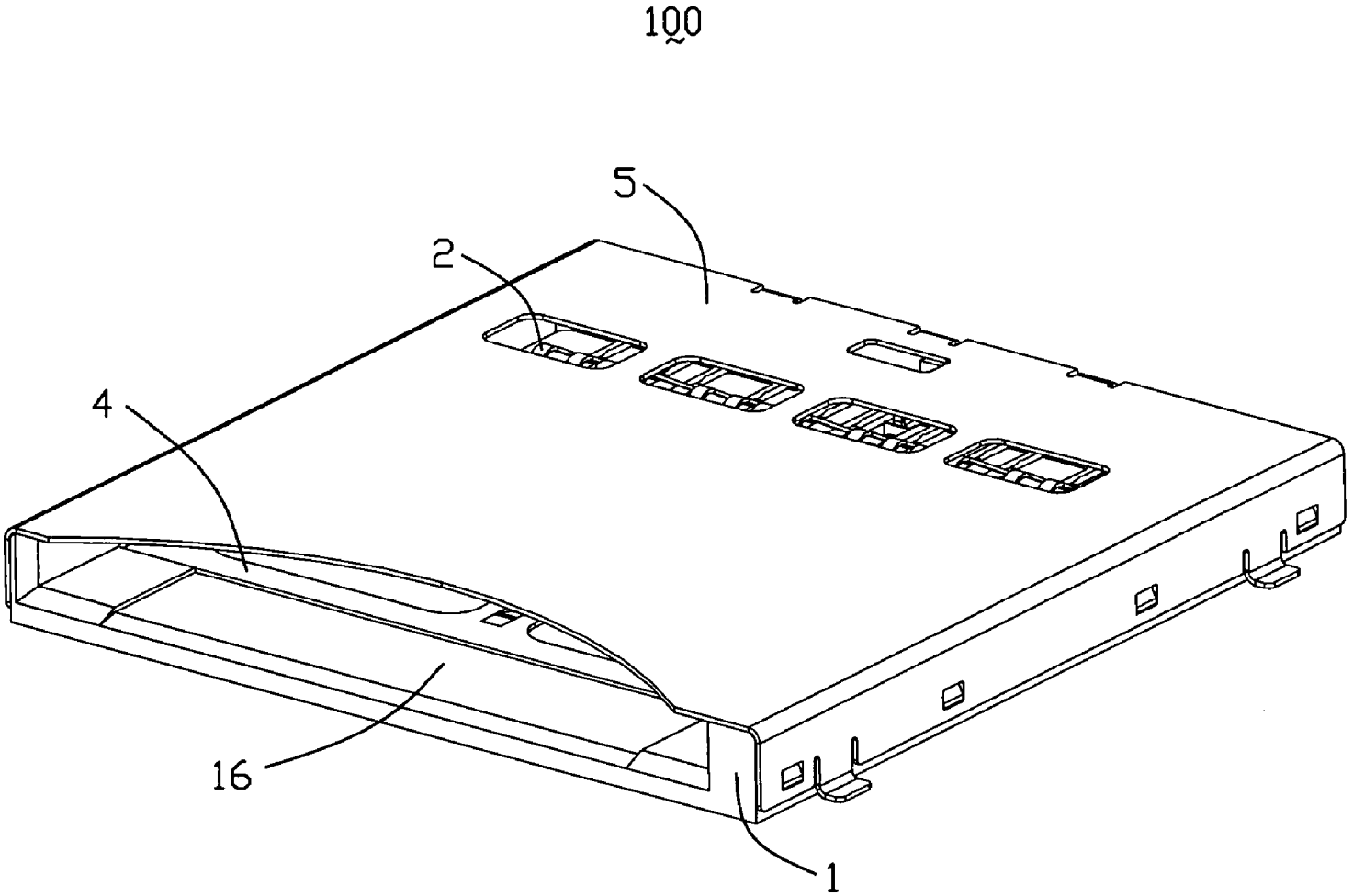
FIG. 2 is another perspective view of the memory card connector, but viewed from another aspect.
Figure 4:
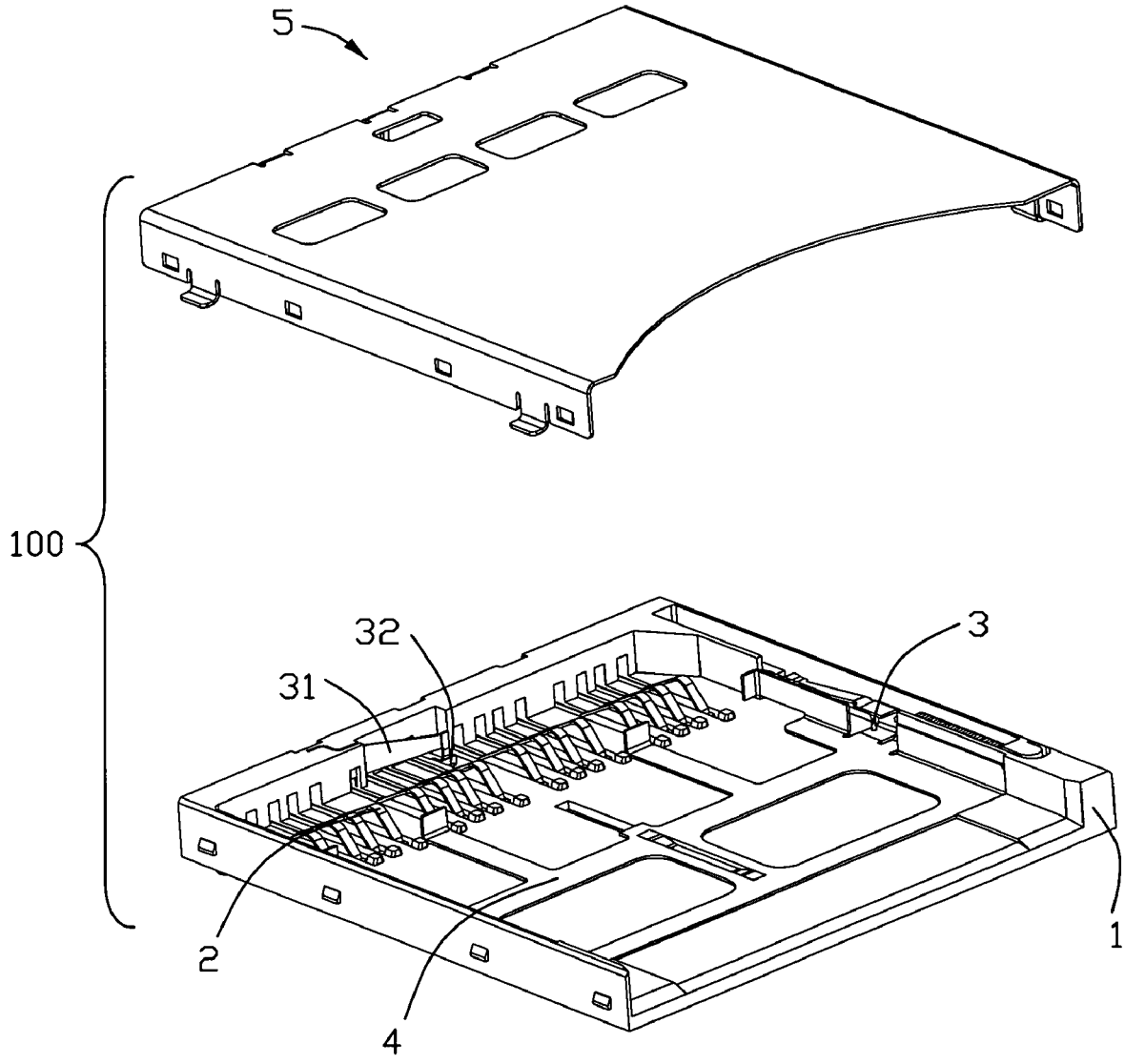
FIG. 4 is another part exploded perspective view of the memory card connector similar to FIG. 3, while taken from another aspect.
Figure 9:
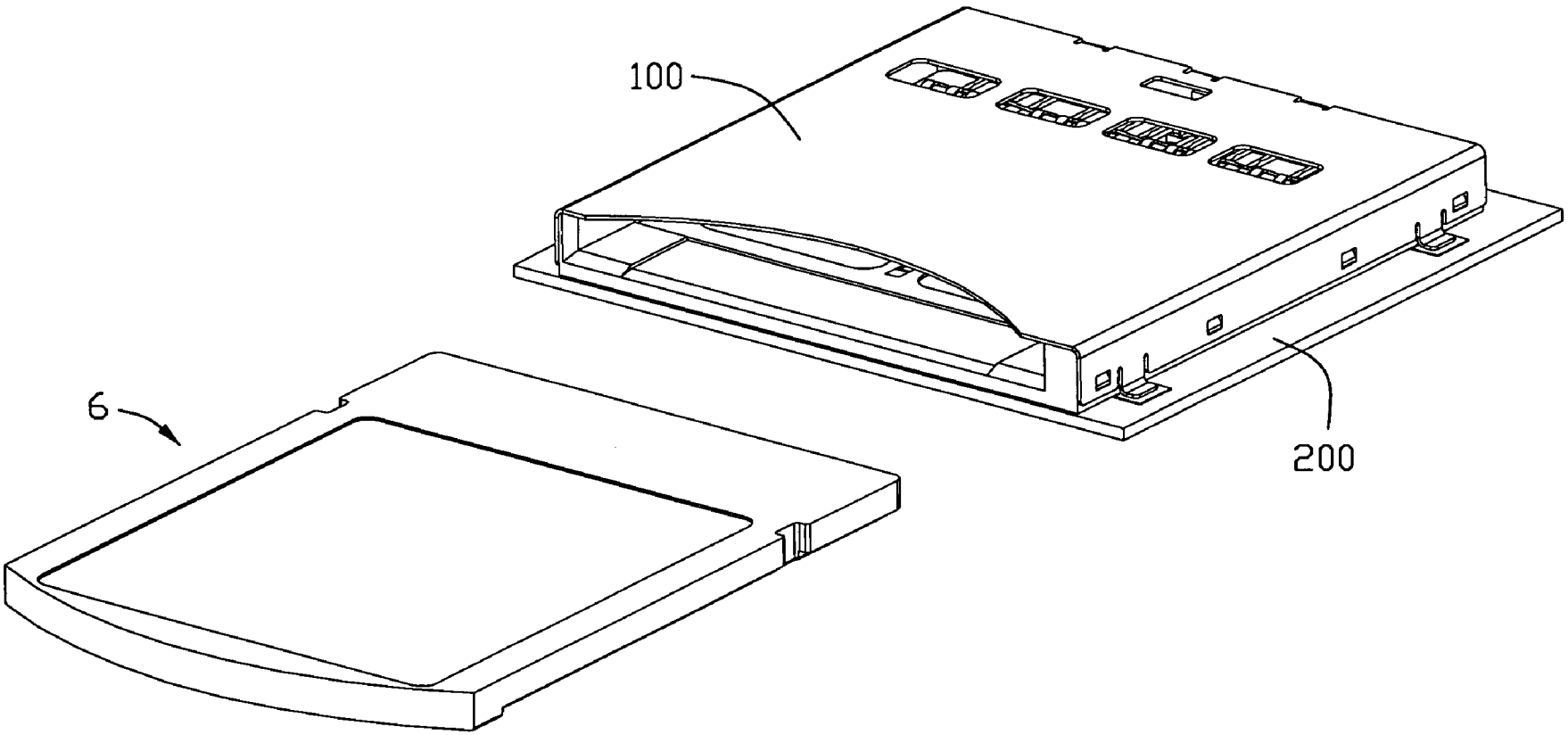
FIG. 9 is a perspective view of the memory card connector mounted on a printed circuit board (PCB) showing a memory card detached from the memory card connector.

Referring to FIGS. 1, 4 and 9, a memory card connector 100 mounted on a PCB 200 (shown in FIG. 9) is disclosed for receiving a memory card 6. The memory card connector 100 includes an insulative housing 1, a plurality of contacts 2 retained in the insulative housing 1, a pair of switch contacts 3, a card ejection mechanism 4 and a metal shell 6 covering the insulative housing 1.

Figure 3:
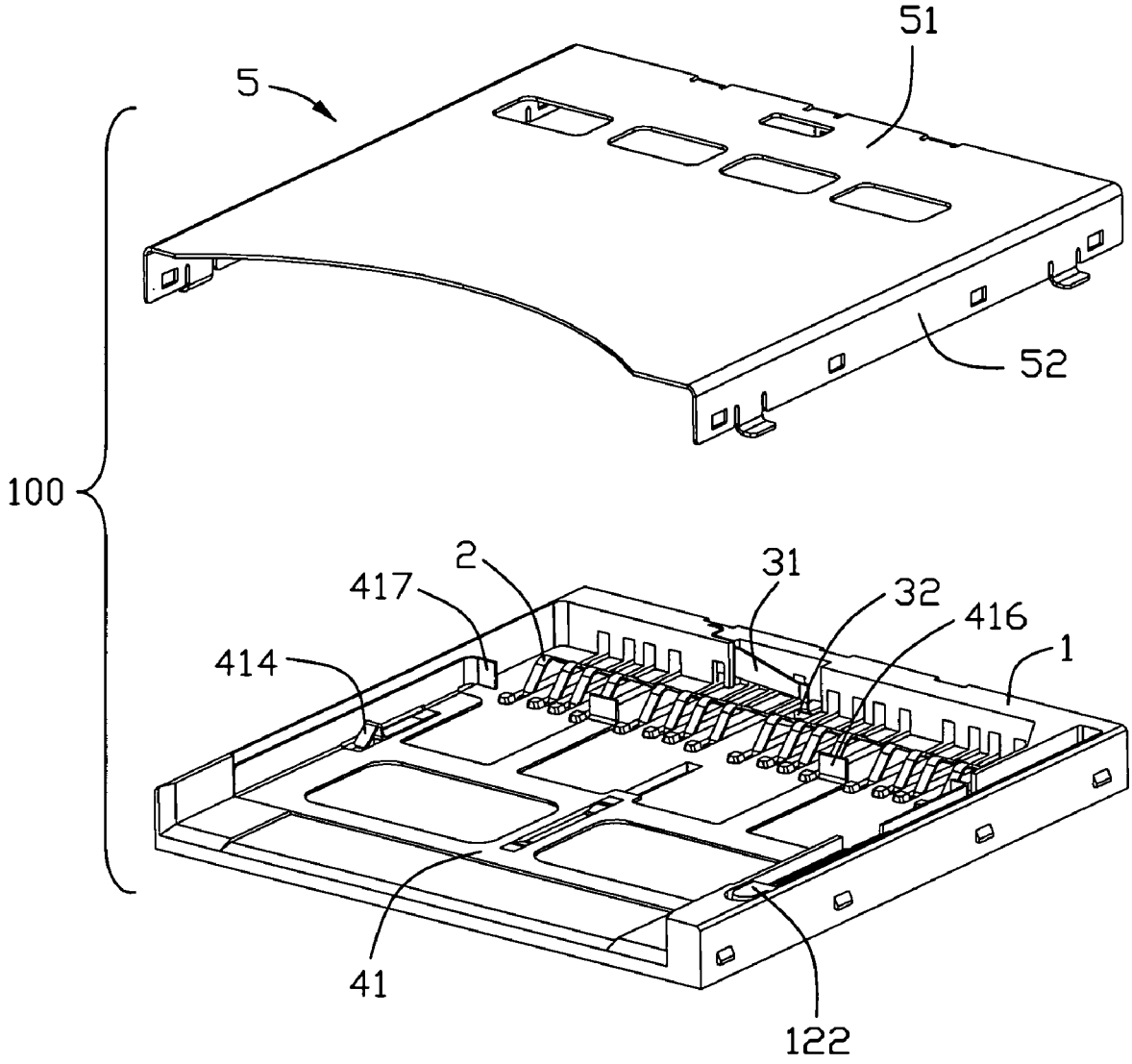
FIG. 3 is a part exploded perspective view of the memory card connector.
Figure 6:
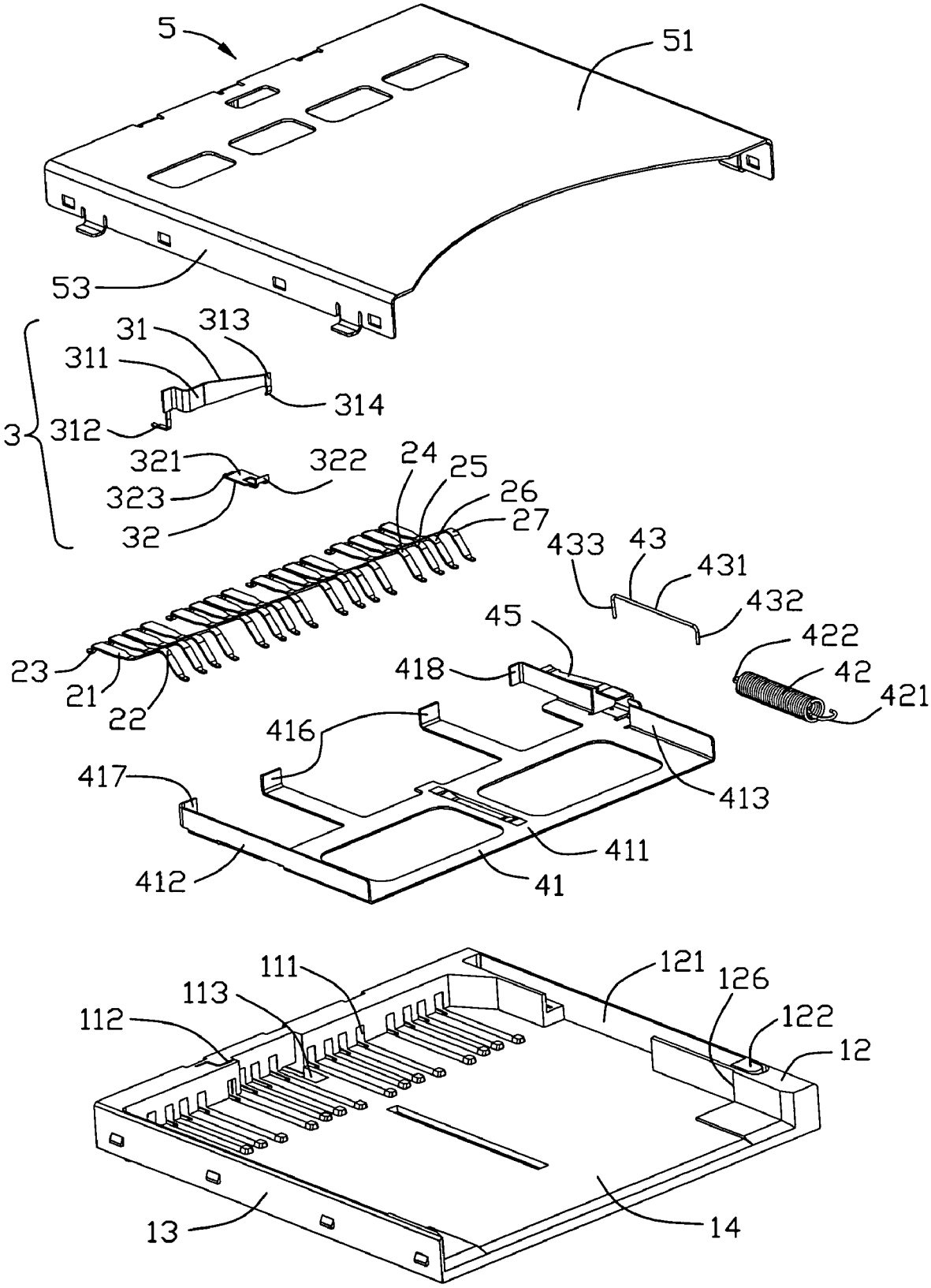
FIG. 6 is another exploded view of the memory card connector similar to FIG. 5, while taken from another aspect.

Referring to FIGS. 3 and 6, the insulative housing 1 includes a rear wall 11, a pair of first and second sidewalls 12, 13 extending forwardly from lateral sides of the rear wall 11, and a bottom wall 14 connecting the rear wall 11 and the pair of first and second sidewalls 12, 13. A card receiving cavity 16 is disposed between the first and the second sidewalls 12, 13, and located over the bottom wall 14. The rear wall 11 includes a plurality of passageways 111 for mounting the contacts 2 and a plurality of first and second mounting slots 112, 113 for mounting the switch contacts 3. The passageways 111 and the second mounting slots 113 further extend forwardly to the bottom wall 14. The first side wall 12 defines a chamber 121 communicating with the card receiving cavity 16 for mounting the card ejection mechanism 4. The insulative housing 1 includes a retaining block 122 at one end of the chamber 121 and a heart-shaped cam 123 (shown in FIG. 7) at the other end of the chamber 121. The bottom wall 14 includes a plurality of raised portions at the front of the passageways 111 for preventing wrong cards from being inserted into the card receiving cavity 16. The first and the second side walls 12, 13 respectively define a first and second step portions 126, 136 for positioning the card ejection mechanism 4 in an original position.

Figure 5:
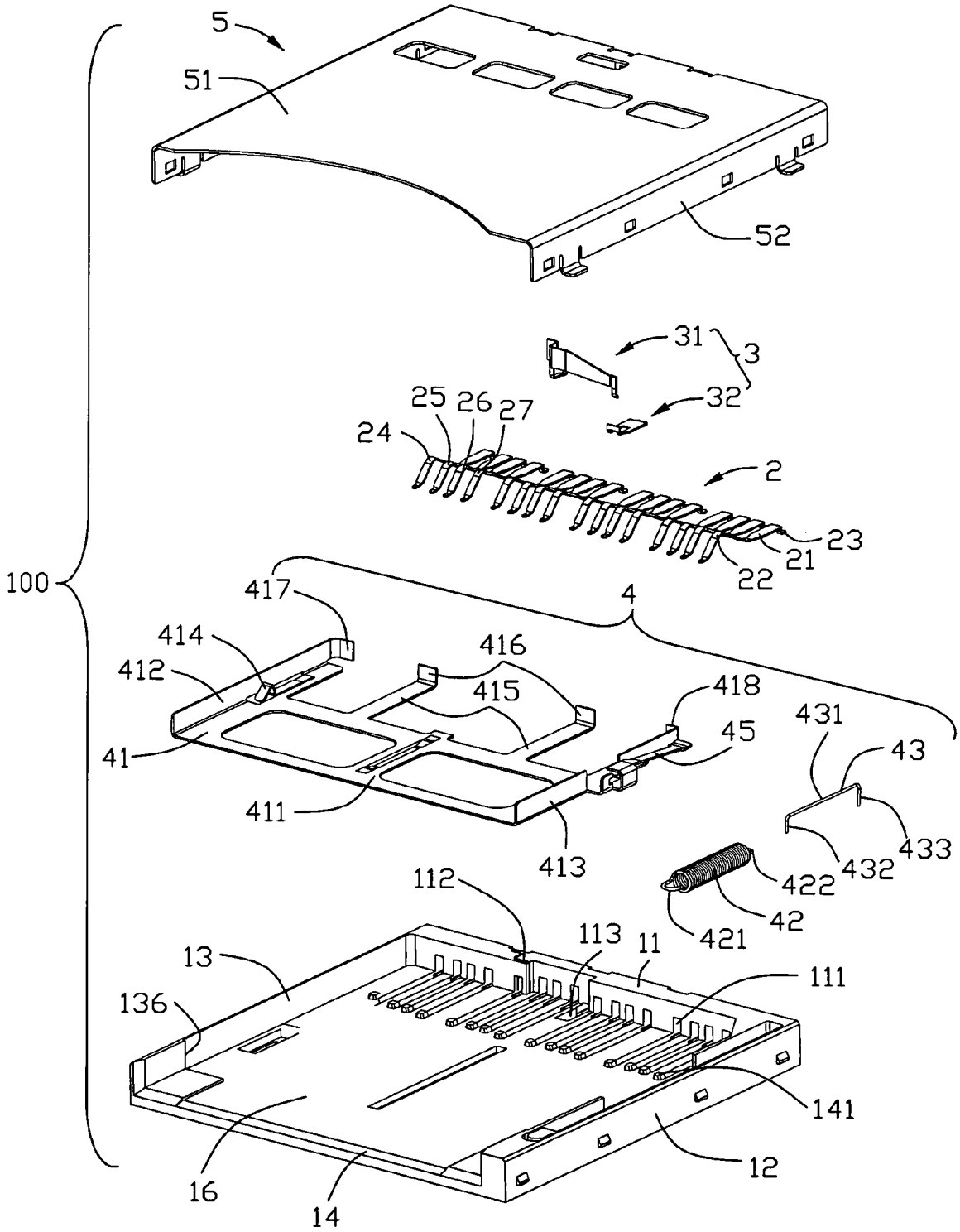
FIG. 5 is an exploded view of the memory card connector.

Referring to FIGS. 3 to 7, the contacts 2 are arranged in a single line along a transverse direction perpendicular to a front-to-rear direction. The contacts 2 are divided into four contact groups with each contact group having four contacts 2. The four contacts 2 of each contact group include a power contact 24, a first signal contact (contact of Data –) 25, a second signal contact (contact of Data +) 26 and a grounding contact 27 in turn as shown in FIG. 5. The four contact groups are of the same contact arrangement and are similar to the USB standard. Each contact group is adapted for transmitting USB or similar-USB signals. Way of USB signal transmission is used to memory card connectors in order to improve high-speed signal transmission. As a result, the memory card connector 100 of the present invention can also be called USB card connector. A space between the adjacent two contact groups is much larger than that of the adjacent two contacts in each contact group. Each contact 2 includes a retaining portion 21 received in the passageways 111, a flexible contact portion 22 extending from the retaining portion 21 and a tail portion 23 extending beyond the rear wall 11 to be soldered to the PCB 200. The contact portions 22 protrude into the card receiving cavity 16 for mating with the memory card 6.

The switch contacts 3 include a first switch contact 31 and a second switch contact 32 detachably mating with the first switch contact 31 determined by insertion positions of the memory card 6. The first switch contact 31 includes a first mounting portion 311 retained in the first mounting slot 112, a first soldering portion 312 extending from the first mounting portion 311, and a spring arm 313 extending from the first mounting portion 311. The spring arm 313 further includes a first contact section 314 at a distal end thereof.

The second switch contact 32 includes a second mounting portion 321 retained in the second mounting slot 113, a second soldering portion 323 and a second contact section 322 extending from opposite ends of the second mounting portion 321. The first contact section 314 normally attaches to the second contact section 322 with insertion of the memory card 6 into the card receiving cavity 16.

Figure 10:
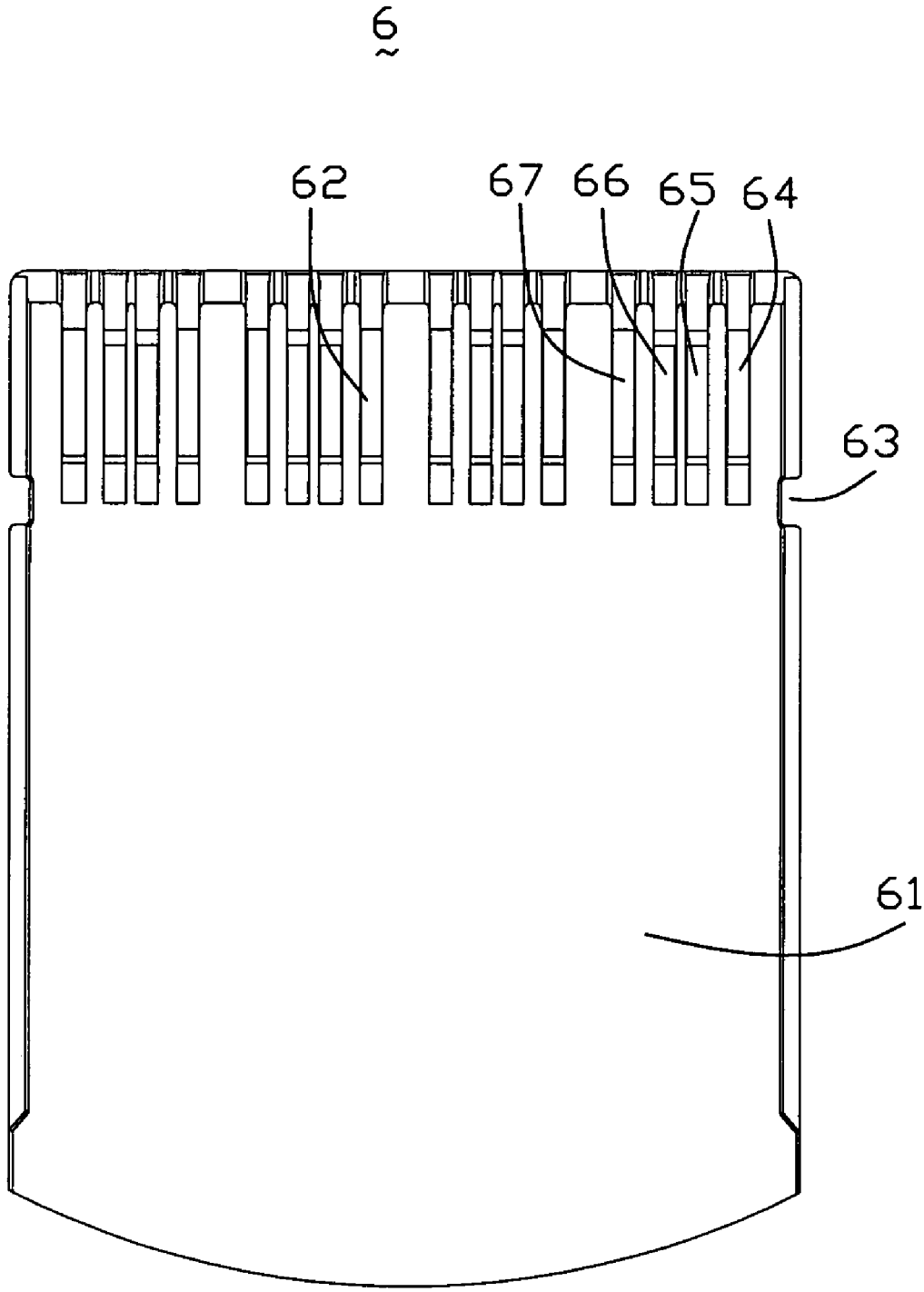
FIG. 10 is a bottom view of the memory card showing metal pad arrangement thereof.

The card ejection mechanism 4 comprises a slider 41, an elastic member which is a spring 42 in the preferred embodiment and a link rod 43. The slider 41 is stamped from metal sheet and includes a body portion 411 and a pair of first and second side portions 413, 412 extending upwardly from lateral sides of the body portion 411. The body portion 411 includes an elastic raised card lock 414 adjacent to the second side portion 412 for abutting against a notch 63 (shown in FIG. 10) of the memory card 6. The slider 41 further includes a pair of separate extensions 415 extending backwardly from the body portion 411. Each extension 415 includes a raised actuation portion 416 located in the card receiving cavity 16 to abut against a front end of the memory card 6 in order that the slider 41 can be driven by the memory card 6 along the front-to-rear direction. The first and the second side portions 413, 412 both includes an abutting sections 417, 418 sidewardly extending into the card receiving cavity 16 for abutting against the memory card 6. The spring 42 includes one end 421 abutting against the retaining block 122 and the other end 422 fixed to the first side portion 413 of the slider 41. The link rod 43 includes a middle portion 431, a first hook 432 and a second hook 433 downwardly bending from opposite ends of the middle portion 431. The first hook 432 is fixed to the first side portion 413 for retaining purpose. The second hook 433 is moveable in the heart-shaped cam 123. The working theory of the card ejection mechanism 4 is obvious to those of ordinary skill in the art, so the detailed description is omitted hereinafter.

The metal shell 5 is stamped from a metal sheet and includes a top wall 51 and a pair of bending portions 52, 53 bending downwardly from lateral edges of the top wall 61 for abutting against the first and the second sidewalls 12, 13 of the insulative housing 1 so that the metal shell 5 can be retained on the insulative housing.

The memory card 6 includes a plurality of flat contact pads 62 on a bottom side 61 thereof. The contact pads 62 are divided into four contact groups with same arrangement. Each contact group includes four contact pads 62 designated with number 64, 65, 66, 67 for mating with contacts 24, 25, 26, 27 for signal transmission. The arrangement of the four contact pads 64, 65, 66, 67 is similar to contact arrangement of well-known USB flash disk. That is to say, the memory card 6 substantially similar to four side by side USB flash disks for large data storage and high speed signal transmission.

Figure 7:
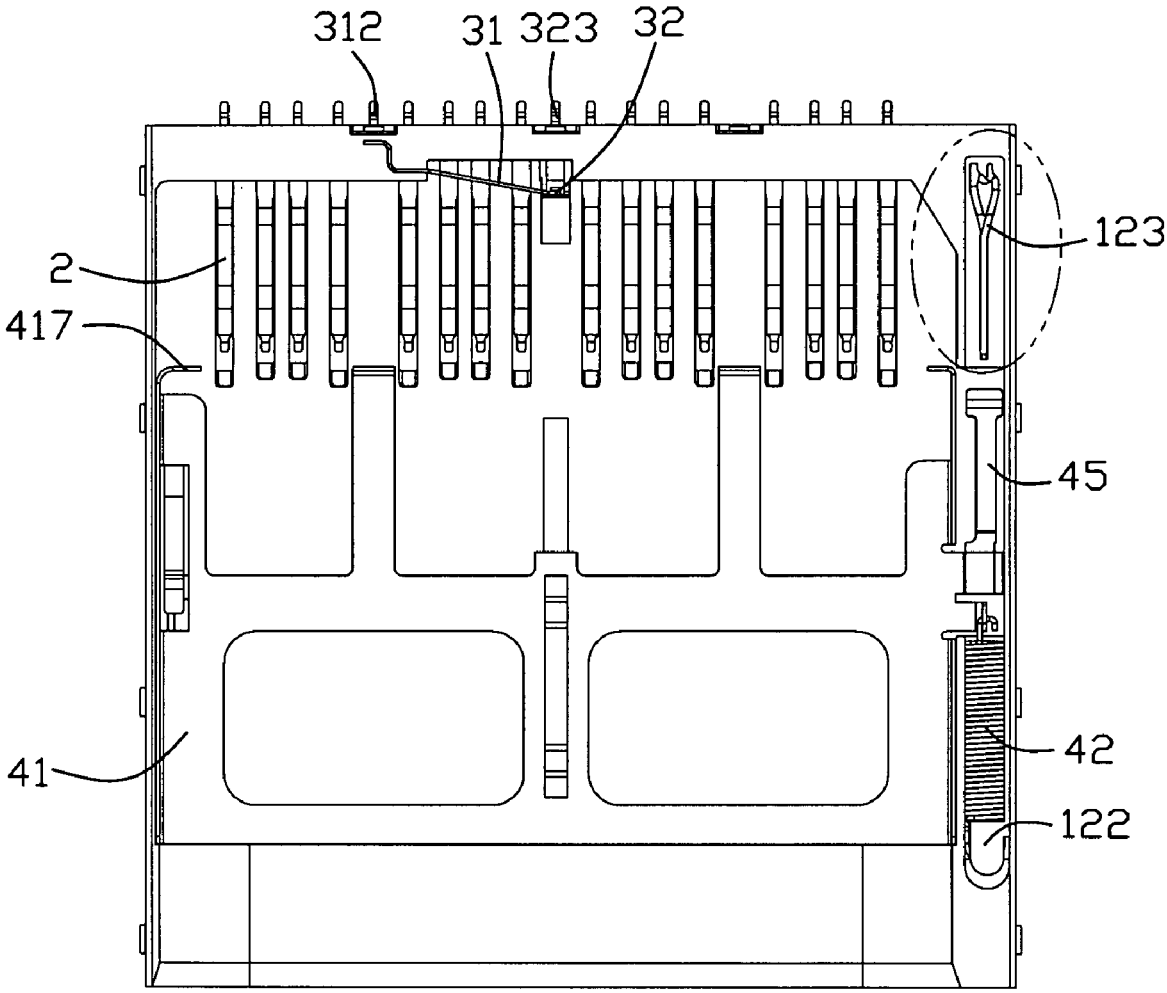
FIG. 7 is a top view of the memory card connector with a metal shell removed therefrom.
Figure 8:
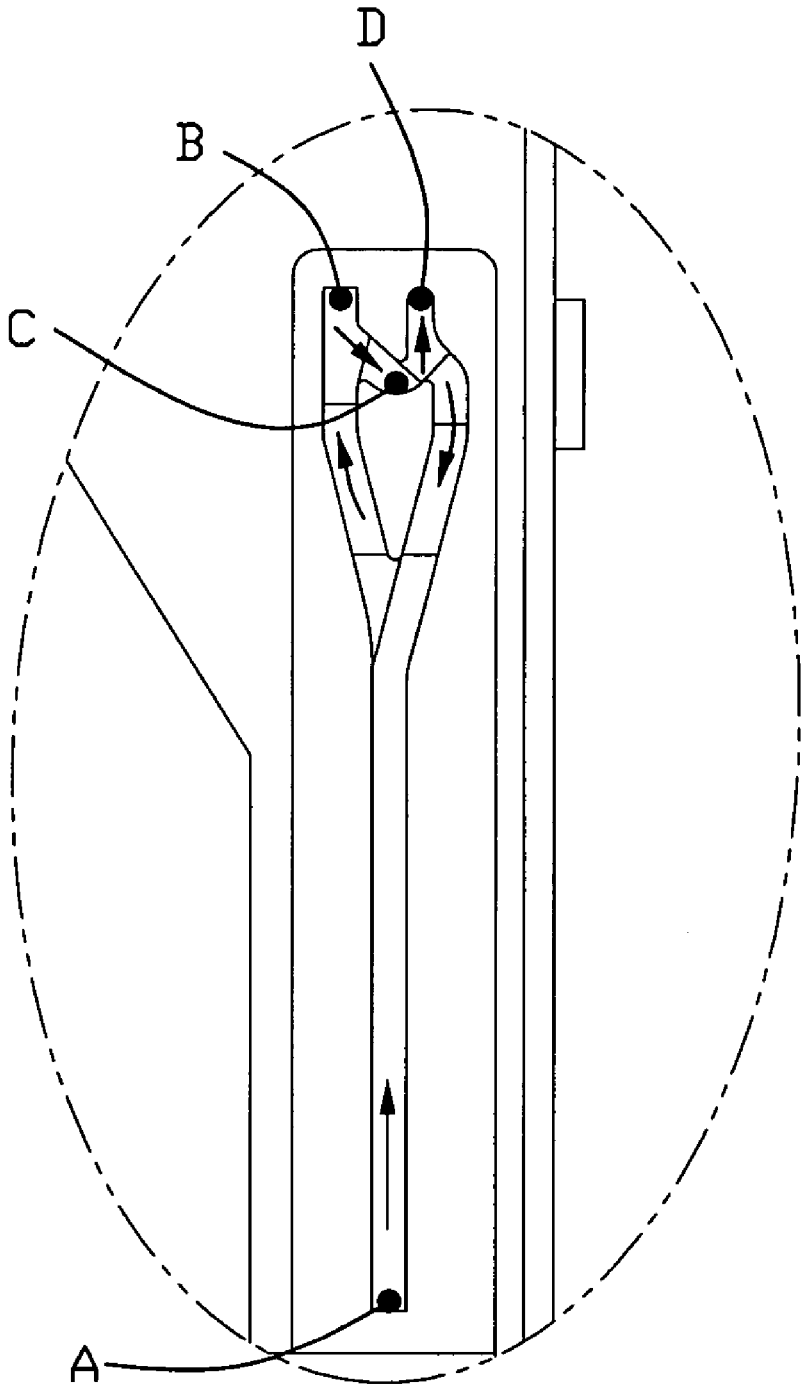
FIG. 8 is an enlarged view of the circle portion shown in FIG. 7.

Referring to FIGS. 7 and 8, when the memory card 6 is inserted into the card receiving cavity 16 of the insulative housing 1, the second hook 433 of the link rod 43 moveable in the heart-shaped cam 123 along the arrow direction. In preliminary position, the second hook 433 is located at position A. with further insertion of the memory card 6, the front end of the memory card 6 abuts against the actuation portion 416 and the card lock 414 recessed into the notch 63 of the memory card 6. Then, the slider 41 is driven by the memory card 6 and moveable along the front-to-rear direction towards the rear wall 11. When the memory card 6 is deepest inserted into the card receiving cavity 16 and the second hook 433 is located at position B, the spring arm 313 is driven by the memory card 6 as a result that the first contact section 314 disengages with the second contact section 322. Then, release the memory card 6 and the second hook 433 withdraws to position C which is working position of the memory card 6. At the same time, the first contact section 314 engages with the second contact section 322 once again. It is easy to understand that when the second hook 433 locates in different positions B and C, the mating status of the switch contacts 3 are different. It is useful for such different signal change when the memory card 6 reaches its final working position.

Similarly, when the memory card 6 is going to withdraw from the card receiving cavity 16, firstly, the memory card 6 is pushed to reach the deepest insertion again under a condition that the second hook 433 locates at the position D. Under this circumstance, the switch contacts 3 are driven from "on" to "off". And then, when the memory card 6 is fully withdraw from the card receiving cavity, the switch contacts recovers to their normal "on" status. That is to say, when the memory card 6 is going to withdraw from the memory card connector 100, there is also a signal change to show that.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A Universal Serial Bus (USB) card connector, comprising:

an insulative housing comprising a rear wall and a card receiving cavity located forward the rear wall; wherein the insulative housing comprises a pair of first and second side walls extending forwardly from the rear wall, and a bottom wall connecting the pair of side walls, the card receiving cavity being disposed between the pair of first and second side walls; and a plurality of contacts retained in the rear wall and each contact comprising a contact portion protruding to the card receiving cavity, the contacts being divided into first and second contact groups with same contact arrangement in condition that each the first or the second contact group comprises four contacts including a power contact, a D− contact, a D+ contact and a grounding contact for transmitting USB or similar-USB signals; wherein a space between the first and the second contact groups is much larger than that of the adjacent two contacts in each the first or the second contact group;

a card ejection mechanism which includes a slider mounted on the bottom wall, a spring and a link rod mating with the slider, the spring including one end abutting against the insulative housing and the other end abutting against the slider, and wherein the insulative housing defines a heart-shaped cam, and the link rod comprises one hook fixed to the slider and the other hook movable in the heart-shaped cam; wherein the slider comprises a main portion attached to the bottom wall of the insulative housing and an extension extending backwardly from the main portion, the extension being moveable in the space between the first and the second contact groups along a front-to-rear direction.

2. The Universal Serial Bus (USB) card connector according to claim 1, wherein the bottom wall includes a plurality of raised portions located forward distal ends of the contact portions in order to prevent wrong insertion of other cards into the card receiving cavity.

3. The Universal Serial Bus (USB) card connector according to claim 1, wherein the link rod comprises a middle portion connecting the one hook and the other hook, and the slider comprises an integral press portion pressing the middle portion.

4. The Universal Serial Bus (USB) card connector according to claim 1, wherein the slider is stamped from a metal sheet and comprises a pair of first and second side portions perpendicular to the main portion, each of the first and the second side wall defining a step portion abutting against the first and the side portions, respectively.

5. The Universal Serial Bus (USB) card connector according to claim 1, wherein the extension comprises an actuation portion located in the card receiving cavity to abut against a front end of an inserted card in order that the slider can be moveable along the front-to-rear direction.

6. The Universal Serial Bus (USB) card connector according to claim 1, wherein the main portion includes a flexible raised hook in order to lock the inserted card in a preliminary position.

7. The Universal Serial Bus (USB) card connector according to claim 1, further comprising a pair of switch contacts mounted in the rear wall, the switch contacts including a first switch contact and a second switch contact detachably engaging with each other determined by insertion positions of an inserted card, the pair of switch contacts being of a first status when the inserted card is located in a deepest insertion position, and the pair of switch contacts being of a second status different from the first status when the inserted card is located in a final locking and working position.

8. The Universal Serial Bus (USB) card connector according to claim 1, further comprising a metal shell covering the insulative housing, the metal shell comprising a top wall covering card receiving cavity and a pair of bending portions extending from the top wall to abut against the pair of first and second side walls.

9. A memory card connector, comprising:

an insulative housing including a bottom wall and a card receiving cavity over the bottom wall;

a plurality of contacts retained in the insulative housing and each contact comprising a contact portion protruding to the card receiving cavity, the contacts being divided into first and second contact groups with same contact arrangement in condition that each the first or the second contact group comprises four contacts for transmitting signals; and a card ejection mechanism including a metal slider attached to the bottom wall and moveable along a front-to-rear direction, the slider comprising a main portion and an extension extending backwardly from the main portion; wherein a space between the first and the second contact groups is much larger than that of the adjacent two contacts in each the first or the second contact group; and wherein the extension is moveable in the space between the first and the second contact groups along the front-to-rear direction.

10. The memory card connector according to claim 9, wherein the card ejection mechanism includes a spring and a link rod mating with the slider, the spring including one end abutting against the insulative housing and the other end abutting against the slider, and wherein the insulative housing defines a heart-shaped cam and the link rod comprises one hook fixed to the slider and the other hook movable in the heart-shaped cam.

11. The memory card connector according to claim 9, wherein the extension comprises an actuation portion located in the card receiving cavity to abut against a front end of an inserted card in order that the slider can be moveable along the front-to-rear direction.

12. The memory card connector according to claim 9, further comprising a pair of switch contacts at a rear of the card receiving cavity, the switch contacts including a first switch contact and a second switch contact detachably engaging with each other determined by insertion positions of an inserted card, the pair of switch contacts being of a first status when the inserted card is located in a deepest insertion position, and the pair of switch contacts being of a second status different from the first status when the inserted card is located in a final locking and working position.

13. A card connector assembly comprising:

an insulative housing defining a main supporting plate with a contact area around a rear portion of said supporting plate;

a cover attached to the housing and cooperating with the housing to define a card receiving space;

a plurality of contacts disposed in said contact area with contacting arms extending into card receiving space;

a metallic slider moving along a front-to-back direction in said card receiving space, said slider defining a main seating plate essentially abutting against the main supporting plate with at least one extension, which is essentially located in a middle area of the housing in a lateral direction, crossing said contact area so as to have a raised actuation portion, which extends from the extension and invades the card receiving space, capably move to a rear side of the housing, via engagement with a front edge of an inserted card, without interference with the adjacent contacts located by two sides of the extension wherein said slider further includes a pair of raised abutment sections by two sides of the extension and around two opposite side walls for abutment against the front edge of the inserted card.

14. The card connector assembly as claimed in claim 13, wherein said main seating plate and said main supporting plate defines interengaging devices thereon for restricting lateral relative movement therebetween.

15. The card connector assembly as claimed in claim 13, wherein said main seating plate is essentially laterally dimensioned similar to said main supporting plate, and includes two opposite side walls extending on two side edges so as to retain the corresponding inserted card among said main seating plate and said two opposite side walls.

16. The card connector assembly as claimed in claim 13, wherein said contacting arms extend upwardly above the main supporting plate and said main seating plate, and essentially located at a same level with the raised actuation portion.

* * * * *